US006807689B1

(12) United States Patent
Royko et al.

(10) Patent No.: US 6,807,689 B1
(45) Date of Patent: Oct. 26, 2004

(54) WHIRLPOOL CONVERSION POOL

(76) Inventors: James Andrew Royko, 374 Fletcher Hollow, Collierville, TN (US) 38017; Mary Alice Royko, 374 Fletcher Hollow, Collierville, TN (US) 38017

( * ) Notice: Subject to any disclaimer, the term of this patent is extended or adjusted under 35 U.S.C. 154(b) by 0 days.

(21) Appl. No.: 10/701,826

(22) Filed: Nov. 4, 2003

(51) Int. Cl.[7] ..... A47K 3/10
(52) U.S. Cl. ..... 4/541.1; 4/546; 4/559
(58) Field of Search ..... 4/541.1–541.6, 4/546, 559, 496, 504, 507, 508

(56) References Cited

U.S. PATENT DOCUMENTS 4,951,326 A * 8/1990 Barnes et al. ..... 4/494
5,172,433 A * 12/1992 Lake ..... 4/541.4
5,485,707 A * 1/1996 Wilkes ..... 52/741.3
5,826,855 A * 10/1998 Dick ..... 251/144
6,578,208 B1 * 6/2003 Lytle ..... 4/507

* cited by examiner

*Primary Examiner*—Gregory L. Huson
*Assistant Examiner*—Huyen Le
(74) *Attorney, Agent, or Firm*—Michael I. Kroll

(57) ABSTRACT

A kit for converting a whirlpool bathtub (12) into a conventional bathtub for the purpose of eliminating the potential for bacterial exposure to the user of the whirlpool bath by sealing the various ports is provided. The kit is comprised of O-rings (32), a test plug (23) that is expanded within the pump inlet pipe (30) and cover (34). Also O-rings (32) and covers (40) are used in replacement of the original jest (20), air switch (24), and air inlet (22).

8 Claims, 10 Drawing Sheets

WHIRLPOOL CONVERSION POOL

BACKGROUND OF THE INVENTION

1. Field of the Invention

The present invention relates generally to bathtubs and, more specifically, to a kit for converting a whirlpool bathtub into a bathtub for the purpose of eliminating the potential for bacterial exposure to the user of the whirlpool by sealing the various ports. The kit is comprised of O-rings, a test plug that is expanded within the pump inlet pipe and covers. The components are used in replacement of the original jets, air inlet, air switch and an inlet cover.

2. Description of the Prior Art

There are other fittings designed for whirlpool tubs. Typical of these is U.S. Pat. No. 3,890,655 issued to Mathis on Jun. 24, 1975.

Another patent was issued to Doerr, et al. on Oct. 19, 1976 as U.S. Pat. No. 3,986,217. Yet another U.S. Pat. No. 4,359,790 was issued to Chalberg on Nov. 23, 1982 and still yet another was issued on Nov. 22, 1983 to Reynoso as U.S. Pat. No. 4,416,030.

Another patent was issued to James on Jan. 14, 1986 as U.S. Pat. No. 4,563,781. Yet another U.S. Pat. No. 4,901,926 was issued to Klotzbach on Feb. 20, 1990. Another was issued to Klotzbach on May 7, 1991 as U.S. Pat. No. 5,012,535 and still yet another was issued on May 16, 1995 to Booth as U.S. Pat. No. 5,414,878.

Another patent was issued to Booth on Dec. 24, 1996 as U.S. Pat. No. 5,587,023. Yet another U.S. Pat. No. 6,395,167 was issued to Mattson, Jr., et al. on May 28, 2002.

U.S. Pat. No. 3,890,655

Inventor: Cleo D. Mathis

Issued: Jun. 24, 1975

A whirlpool jet outlet for bathtubs, therapy tanks, swimming pools and the like is disclosed. A housing has a hollow interior chamber. A water inlet supplying water under pressure is connected through one side of the housing to the inner end of the chamber. A Venturi air inlet is connected to the inner end of the chamber to speed the flow of water through and out of the chamber. A water outlet is screw threadedly mounted in the front of the chamber. The housing extends through an opening in the side of the tub, the water outlet being substantially flush with the inside of the tub. The wall of the tub is gripped between the water outlet and the housing. A jet outlet control is mounted for rotation by a coin or the like within the water outlet to control the direction of water flow into the tub.

U.S. Pat. No. 3,986,217

Inventor: John D. Doerr, et al.

Issued: Oct. 19, 1976

A whirlpool bath device having a valve assembly including a concentric ring and cap for manual control of the water inlet pressure and the flow of air entrained in the water, the cap being spring loaded to afford pressure relief and prevent breakage. The water and entrained air emerge into the tub through a discharge outlet having an adjustable and wear-compensating nozzle provided with a dished flange engageable by the foot of the user for controlling the direction of the output flow through the nozzle.

U.S. Pat. No. 4,359,790

Inventor: Philip E. Chalberg

Issued: Nov. 23, 1982

A suction outlet assembly providing a path through which water within a whirlpool bath may be pumped out for recirculation. The assembly comprises three principal components, namely, an elbow structure which includes an integral flange and threaded pipe for protruding through a suitable orifice in the wall of the whirlpool bathtub into the interior of the tub; a locking ring having a matching threaded annular surface for securing the elbow structure against the tub wall by tightening the locking ring from the readily accessible interior side of the tub wall; and a suction cover which is designed to engage the locking ring in a fixed spaced-apart relation to provide a finished aesthetically appealing appearance to the assembly while providing safe multiple exit paths to the water flowing therethrough. These three components of the present invention are of unique but simple structure which may be manufactured from molded plastic. The assembly may be readily installed in a whirlpool bathtub with only limited access to the tub exterior immediately adjacent the orifice through which the assembly protrudes. The assembly requires only a minimum fixed volume adjacent the tub exterior surface to accommodate the elbow structure of the invention.

U.S. Pat. No. 4,416,030

Inventor: Arturo S. Reynoso

Issued: Nov. 22, 1983

An improved more compact type of fully adjustable spa jet water aerator is provided which is simple, inexpensive, durable, easy to install and use and which features easy separate adjustment of water and air flow therethrough. The aerator can be secured within a spa wall with the exit nozzle and controls readily accessible from within the spa. The aerator comprises a molded unitary housing defining an elongated passageway with water and air conduits disposed in stacked relation on the same side of the passageway to conserve space. The passageway extends to the front of the housing. The conducts have openings communicating with the passageway and a concentric pair of sleeves are threaded into the passageway and manually adjustable to align apertures therein with the conduit openings to control the air and water flow into the passageway. Cylindrical preferably ridged seals with alignable apertures are disposed over the rear ends of the sleeves adjacent the sleeve apertures to prevent fluid leakage. The inner sleeve defines an aerating chamber, and a replaceable flow reducer cylinder is disposed adjacent thereto in the inner sleeve.

U.S. Pat. No. 4,563,781

Inventor: David R. James

Issued: Jan. 14, 1986

A method of disinfecting the circulating system of a whirlpool bath tub installation comprising blanking off or capping a nozzle or nozzles of the bath tub in such manner that a circulating pump and the nozzle(s) together with associated pipework form a closed path. A small supply of disinfecting solution is connected through a valve to the closed path around which the disinfectant solution is circulated by the pump during a disinfection period in order to disinfect the pump, nozzle(s) and associated pipework. A whirlpool bath tub which incorporates a nozzle or nozzles which can be blanked off or capped, thereby providing a closed path and allowing disinfection thereof, by the foregoing method. A whirlpool bath tub installation comprises a tub, nozzles which can be capped, and a disinfectant supply tank. The valve is operable either to connect the pump to circulate water from the tub through the nozzles to which air is fed in the usual manner during bathing or, with the nozzles capped, to circulate disinfectant solution in a closed path which includes the supply tank, nozzles and associated pipework.

U.S. Pat. No. 4,901,926

Inventor: Manfred Klotzbach

Issued: Feb. 20, 1990

A tub including a fluid system has a pump which includes a suction side and a pressure side; a nozzle for introducing a water-and-air mixture into the tub; the nozzle having a nozzle portion; a pressure line connecting the pressure side of the pump with the nozzle portion; a suction opening provided in a bottom region of the tub; and a suction line connecting the suction side of the pump with the suction opening. The fluid system further has a valve provided in the nozzle portion for cutting off fluid flow to the tub; an overflow line having a closable vent opening and being coupled to the suction side of the pump; a device for selectively allowing or blocking fluid communication between the overflow line and the suction line of the pump; and a supply source for introducing a cleaning agent at a location upstream of the nozzle as viewed in a direction of fluid flow therethrough.

U.S. Pat. No. 5,012,535

Inventor: Manfred Klotzbach

Issued: May 7, 1991

A tub including a fluid system has a pump which includes a suction side and a pressure side; a nozzle for introducing a water-and-air mixture into the tub; the nozzle having a nozzle portion; a pressure line connecting the pressure side of the pump with the nozzle portion; a suction opening provided in a bottom region of the tub; and a suction line connecting the suction side of the pump with the suction opening. The fluid system further has a valve provided in the nozzle portion for cutting off fluid flow to the tub; an overflow line having a closable vent opening and being coupled to the suction side of the pump; a device for selectively allowing or blocking fluid communication between the overflow line and the suction line of the pump; and a supply source for introducing a cleaning agent at a location upstream of the nozzle as viewed in a direction of fluid flow there through.

U.S. Pat. No. 5,414,878

Inventor: John W. Booth

Issued: May 16, 1995

A sanitary, cleanable, whirlpool jet apparatus having means for circulating water within a whirlpool without routing the whirlpool water through circulation piping.

U.S. Pat. No. 5,587,023

Inventor: John W. Booth

Issued: Dec. 24, 1996

Method of removing a whirlpool jet apparatus from a whirlpool bathtub for inspection, cleaning or repair.

U.S. Pat. No. 6,395,167

Inventor: Roy W. Mattson, Jr., et al.

Issued: May 28, 2002

A whirlpool bath has a combination suction fixture and disposable filter. The suction fixture is a plastic semi-cylindrical housing attachable to the tub. A removable faceplate is reinforced and resistent to body and hair entrapment. The disposable filter is fibrous having a porous core, wherein the porous core has a series of holes and/or slots graduating in size from small and the outlet end to large at the remote end. The filter, sloped floor of the housing and drain slots provide for low water retention during shutdown.

While these devices may be suitable for the purposes for which they were designed, they would not be suitable for the purposes of the present invention, as hereinafter described.

SUMMARY OF THE PRESENT INVENTION

The present invention discloses a kit for converting a whirlpool bathtub into a conventional bathtub for the purpose of eliminating the potential for bacterial exposure to the user of the whirlpool bath by sealing the various ports. The kit is comprised of O-rings, a test plug that is expanded within the pump inlet pipe and covers. Also, O-rings and covers are used in replacement of the original jets, air switch, and air inlet.

A primary object of the present invention is to provide a kit for converting a whirlpool tub into a regular bathtub.

Another object of the present invention is to provide a kit for a whirlpool tub that will seal the interior tub from the incorporated water circulation system.

Yet another object of the present invention is to provide a kit for a whirlpool tub wherein the motor pump is disconnected from an electrical source.

Still yet another object of the present invention is to provide a kit for a whirlpool tub wherein the vacuum line is disconnected from the water pump.

Another object of the present invention is to provide a kit for a whirlpool tub wherein the jets are removed and an O-ring and cover are fixedly attached to the aperture. Yet another object of the present invention is to provide a kit wherein the air inlet cover is removed and an O-ring and cover are fixedly attached to the aperture.

Yet another object of the present invention is to provide a kit wherein the air switch is removed and an O-ring and cover are fixedly attached to the aperture.

Still yet another object of the present invention is to provide a kit wherein the pump inlet cover is removed and a test plug is inserted therein and covered with an O-ring and cover. The cover is fixed to the whirlpool bath by means of fasteners.

Additional objects of the present invention will appear as the description proceeds.

The present invention overcomes the shortcomings of the prior art by providing a kit for converting a whirlpool bathtub into a bathtub for the purpose of eliminating the potential for bacterial exposure to the user of the whirlpool by sealing the various ports. The kit is comprised of O-rings, a test plug that is expanded within the pump inlet pipe and covers. The components are used in replacement of the original jets, air inlet, air switch and an inlet cover.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
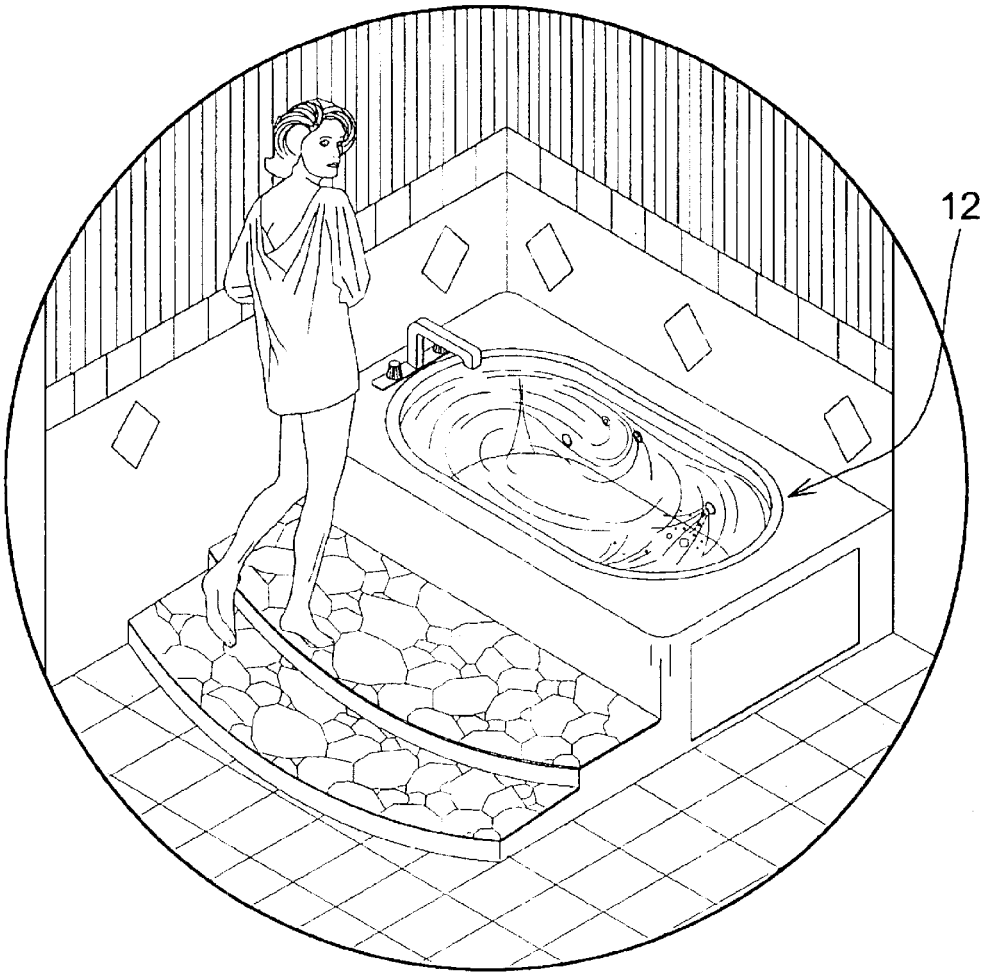
FIG. 1 PRIOR ART
FIG. 1 in an illustrative view of prior art.

With regard to reference numerals used, the following numbering is used throughout the drawings.

10 present invention
12 prior art whirlpool bath
14 access panel
16 pump motor
18 vacuum line
20 jets
22 air inlet cover
24 air switch
26 pump inlet cover
28 test plug
30 pump inlet pipe
32 "O" ring
34 solid cover
36 threaded fastener
38 air switch port
40 solid cover
42 air inlet port
44 jet port

DETAILED DESCRIPTION OF THE PREFERRED EMBODIMENT

The following discussion describes in detail one embodiment of the invention. This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is an illustrative view of a prior art whirlpool bath 12. With each use of a whirlpool bath 12, organic materials combine with mineral deposits from water to form scale deposits. The warm, dark and humid environment of a whirlpool system provides ideal conditions for the growth of microorganisms that can cause many different ailments. Routine cleaning daily and after use with a cleaning solution especially formulated for that purpose will disinfect but not sterilize the whirlpool system leaving ideal conditions for microbial growth. The present invention over comes these problems by providing a retrofit kit that converts a whirlpool bath 12 into a regular bathtub, eliminating bacterial growth within the circulation system of the whirlpool.

Figure 2:
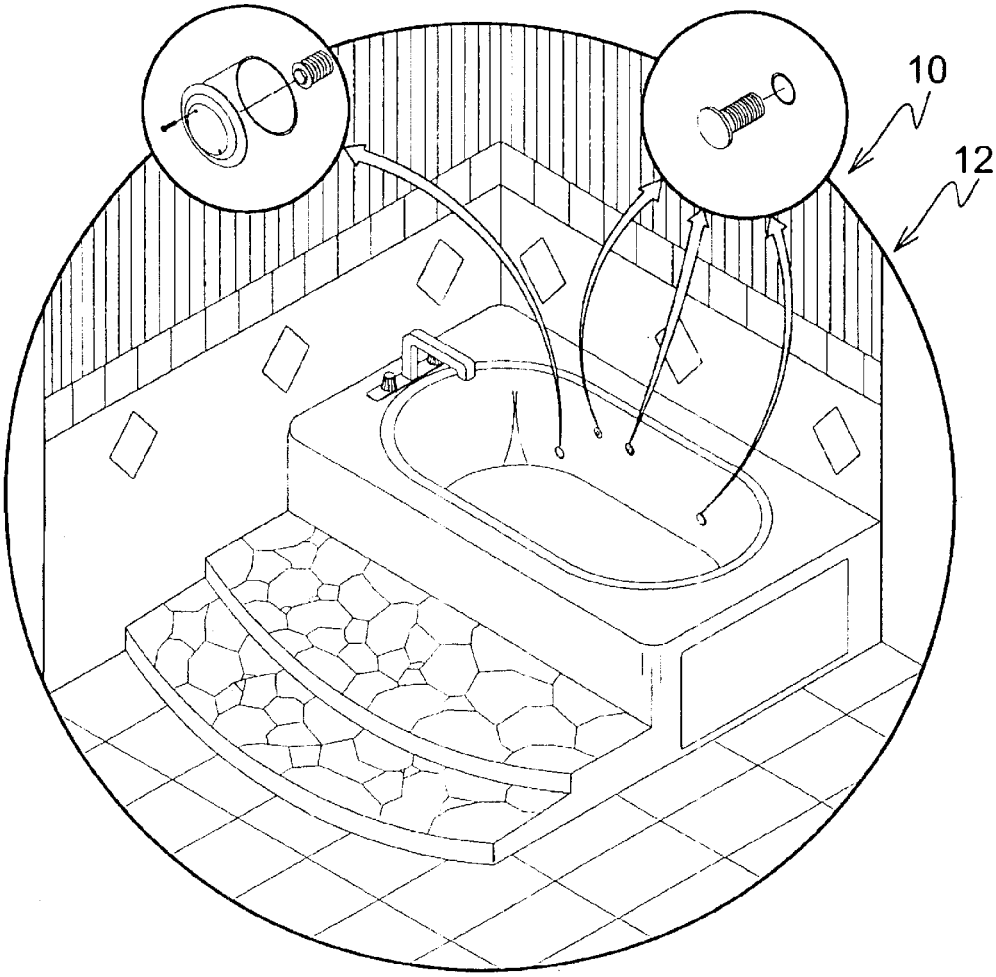
FIG. 2 is an illustrative view of the present invention.

Turning to FIG. 2, shown therein is an illustrative view of the present invention 10. The present invention 10 is a retrofit kit that converts a whirlpool bath 12 into a regular bathtub and eliminates bacterial growth within the circulation system of the whirlpool. The kit is comprised of covers, O-rings and a test plug that is expanded within the pump inlet pipe. The components are used in replacement of the original jets, air inlet, air switch and a pump inlet cover.

Figure 3:
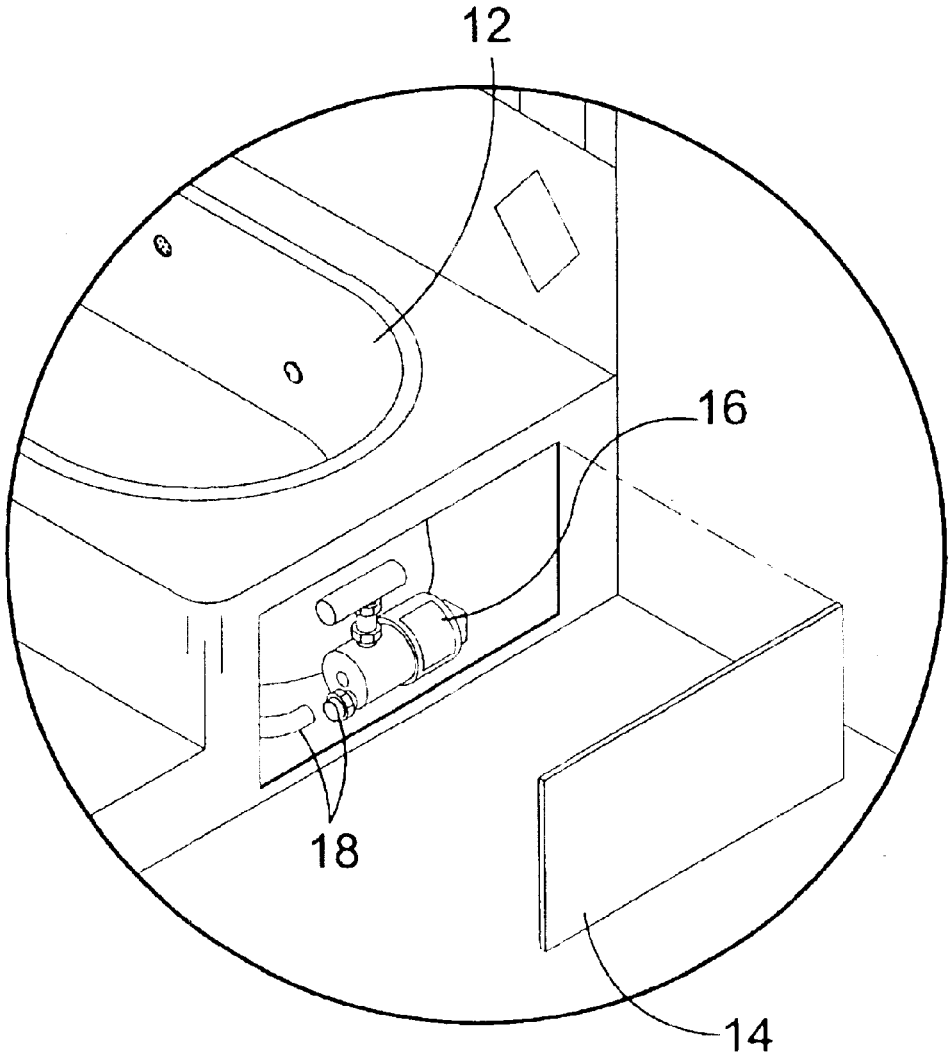
FIG. 3 is an illustrative view of the present invention.

Turning to FIG. 3, shown therein is an illustrative view of the present invention. The installation of the retrofit kit requires a few simple steps. First, the access panel 14 is removed and the motor pump 16 disconnected or unplugged, then the vacuum switch line 18 is removed from the pump. The whirlpool bath 12 is also shown.

Figure 4:
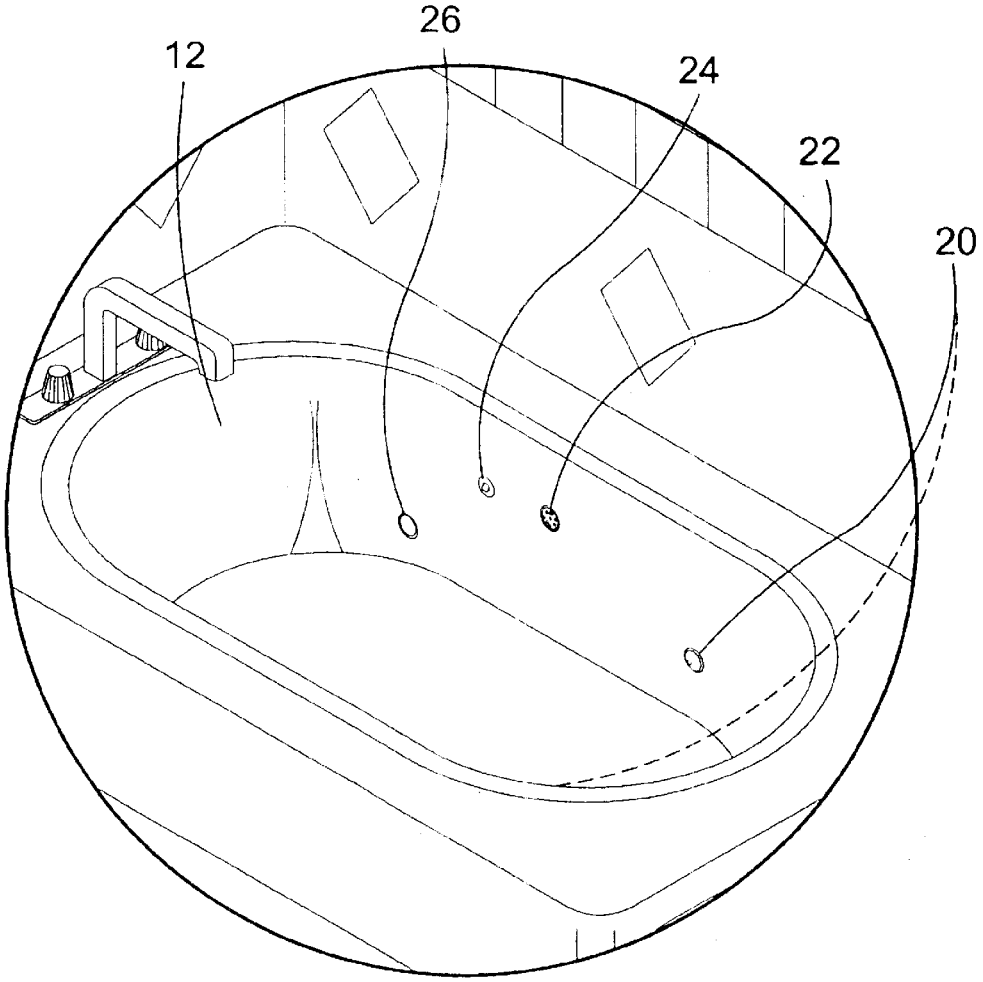
FIG. 4 is an illustrative view of the present invention.

Turning to FIG. 4, shown therein is an illustrative view of the present invention. The next steps involved are the removal of the jets 20, and replacement with a jet cover and O-ring. The air inlet cover 22 and air vacuum switch 24 trim are removed and replaced with jet covers and O-rings and the pump inlet cover 26 is removed and a plumbing test plug is placed into the pipe and expanded. The inlet cover 26 is replaced with a solid cover and an O-ring.

Figure 5:
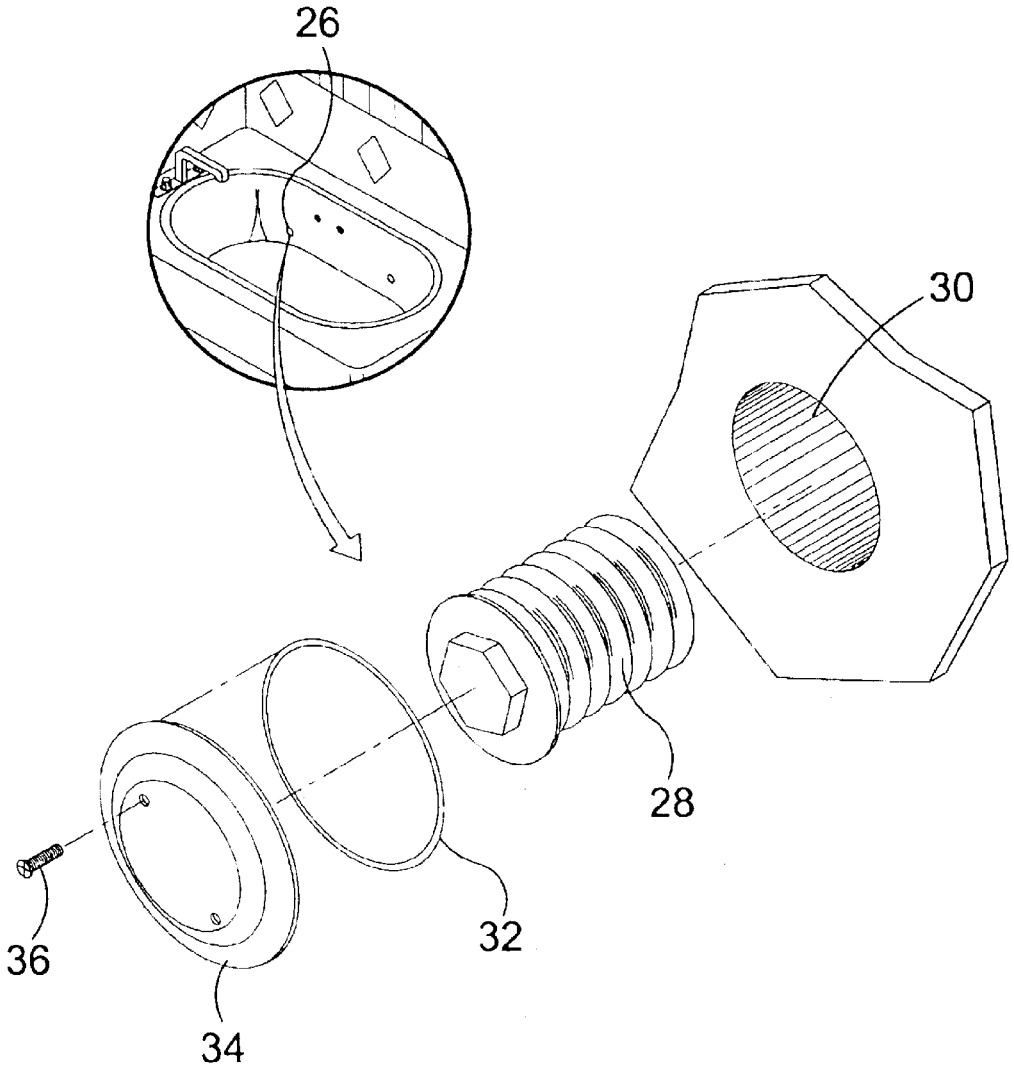
FIG. 5 is an illustrative view of the present invention.

Turning to FIG. 5, shown therein is an illustrative view of the present invention. Shown are the replacement components for the pump inlet cover 26 comprising a test plug 28 that is placed within the inlet pipe 30 and expanded, an O-ring 32 and solid cover 34 that is screwed 36 in place.

Figure 6:
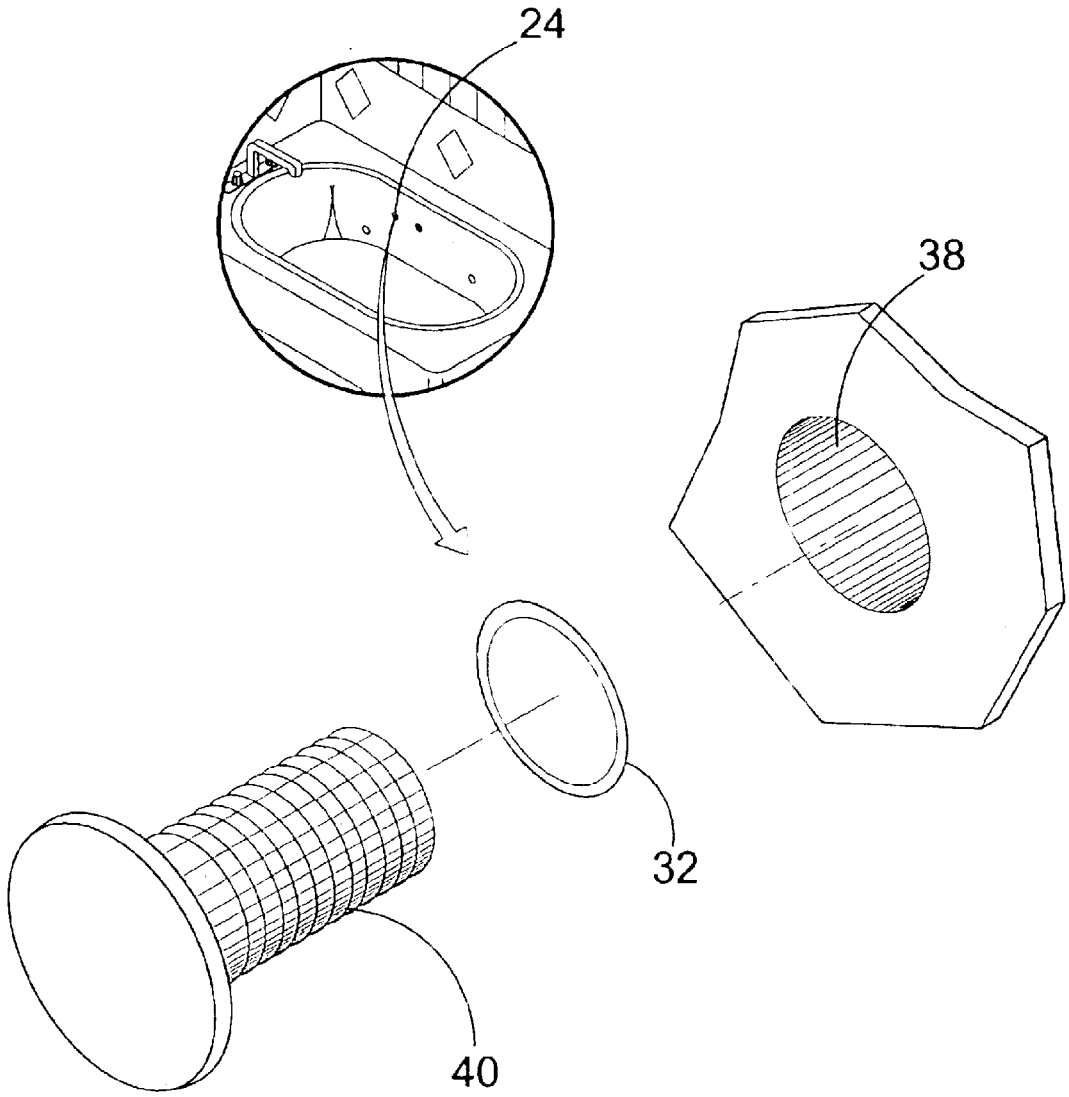
FIG. 6 is an illustrative view of the present invention.

Turning to FIG. 6, shown therein is an illustrative view of the present invention. Shown are the replacement components for the air switch 24 and air switch port 38 comprising an O-ring 32 and solid cover and plug 40.

Figure 7:
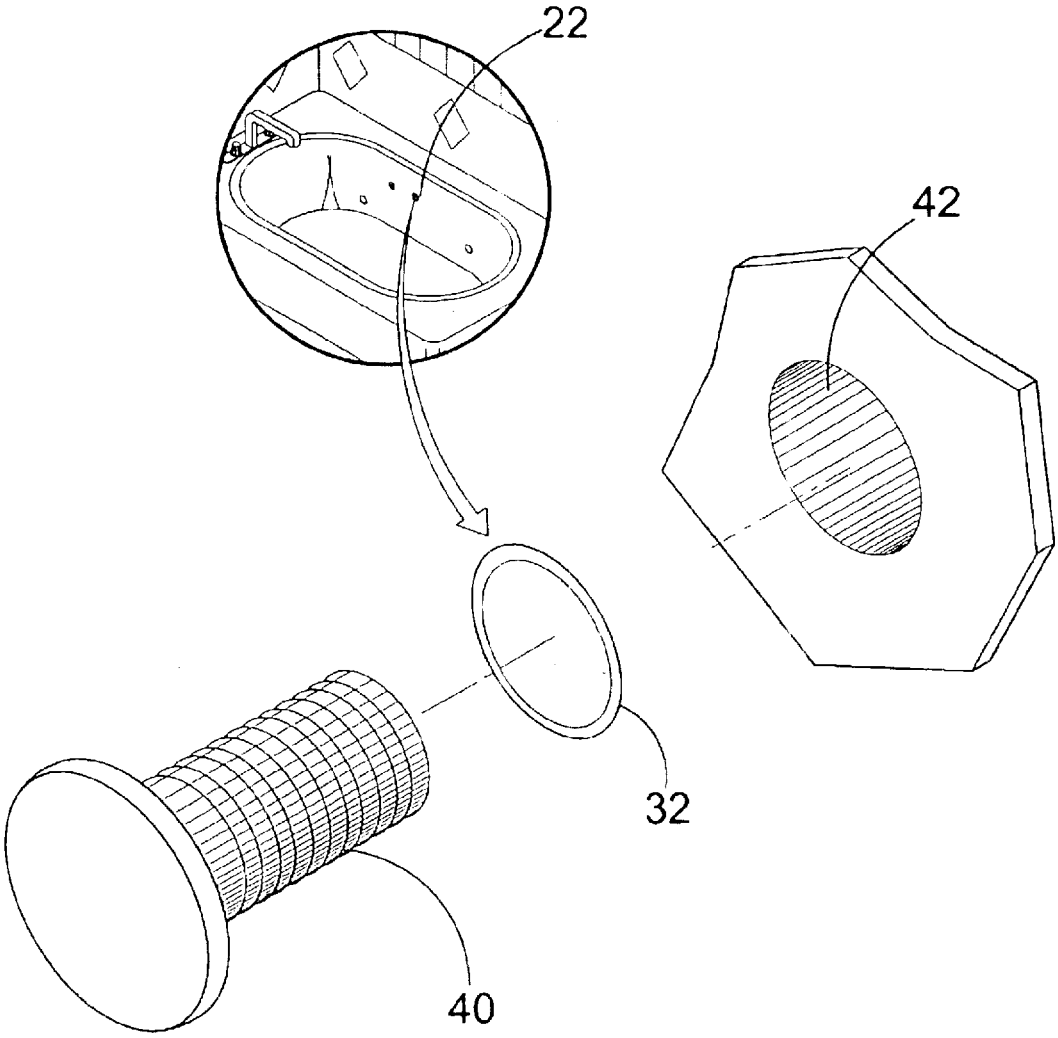
FIG. 7 is an illustrative view of the present invention.

Turning to FIG. 7, shown therein is an illustrative view of the present invention. Shown are the replacement components for the air inlet 22 and air inlet port 42 comprising an O-ring 32 and solid cover and plug 40. When all replacement components are installed, the whirlpool bath can be used as a traditional bath unit.

Figure 8:
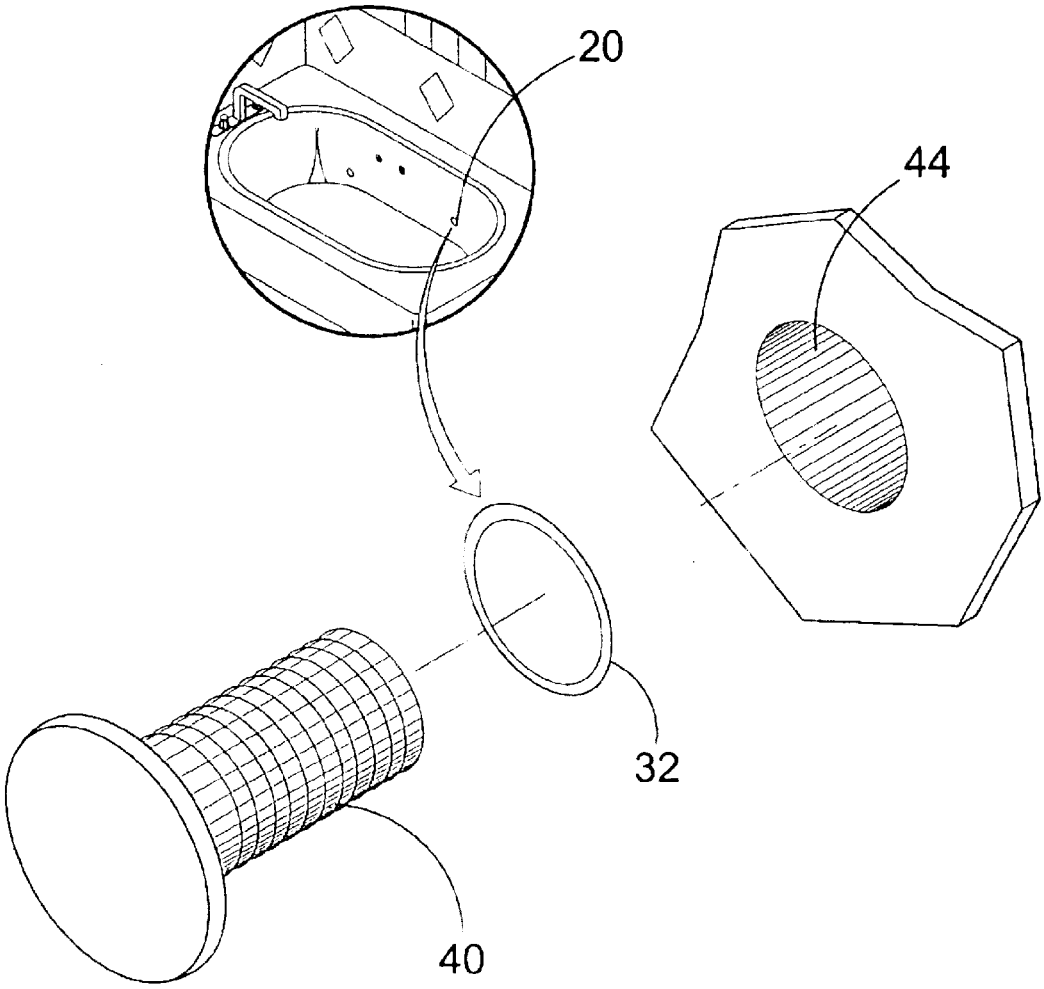
FIG. 8 is an illustrative view of the present invention.

Turning to FIG. 8, shown therein is an illustrative view of the present invention. Shown are the replacement components for the jets 20 and jet port 44 comprising an O-ring 32 and solid cover 40 and plug that replaces the jets.

Figure 9:
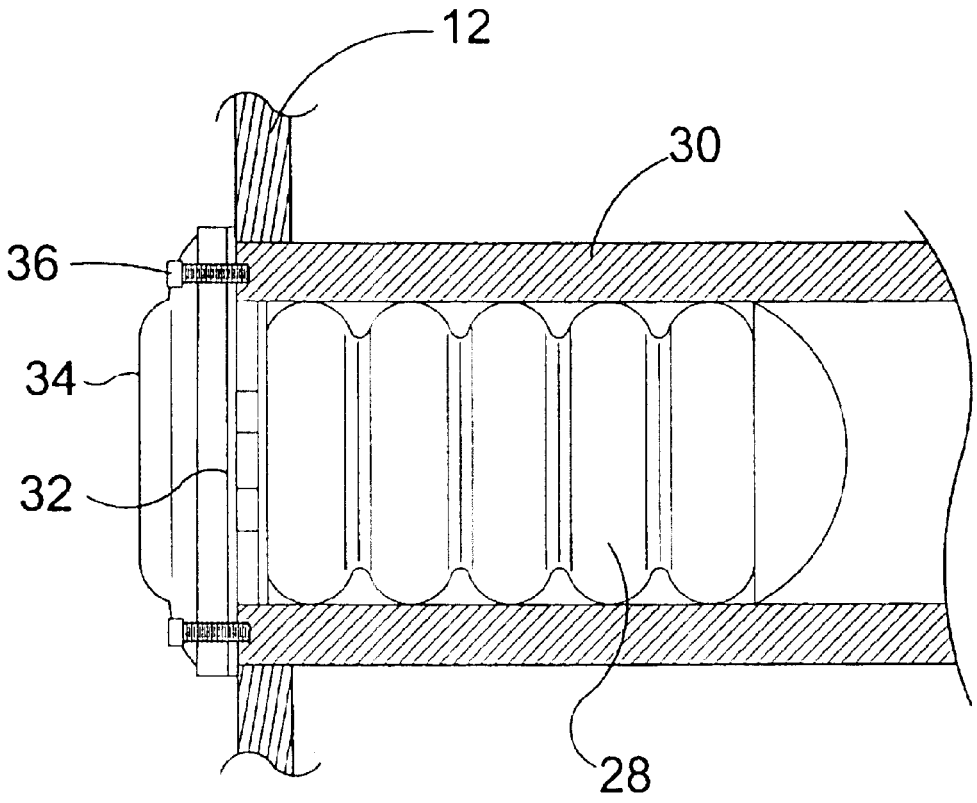
FIG. 9 is a sectional view of the present invention.

Turning to FIG. 9, shown therein is a sectional view of the present invention. Shown are the whirlpool bath 12 and replacement components for the pump inlet cover and pipe 30 having an expandable test plug 28, an O-ring 32 and solid cover 34 that is screwed 36 into place.

Figure 10:
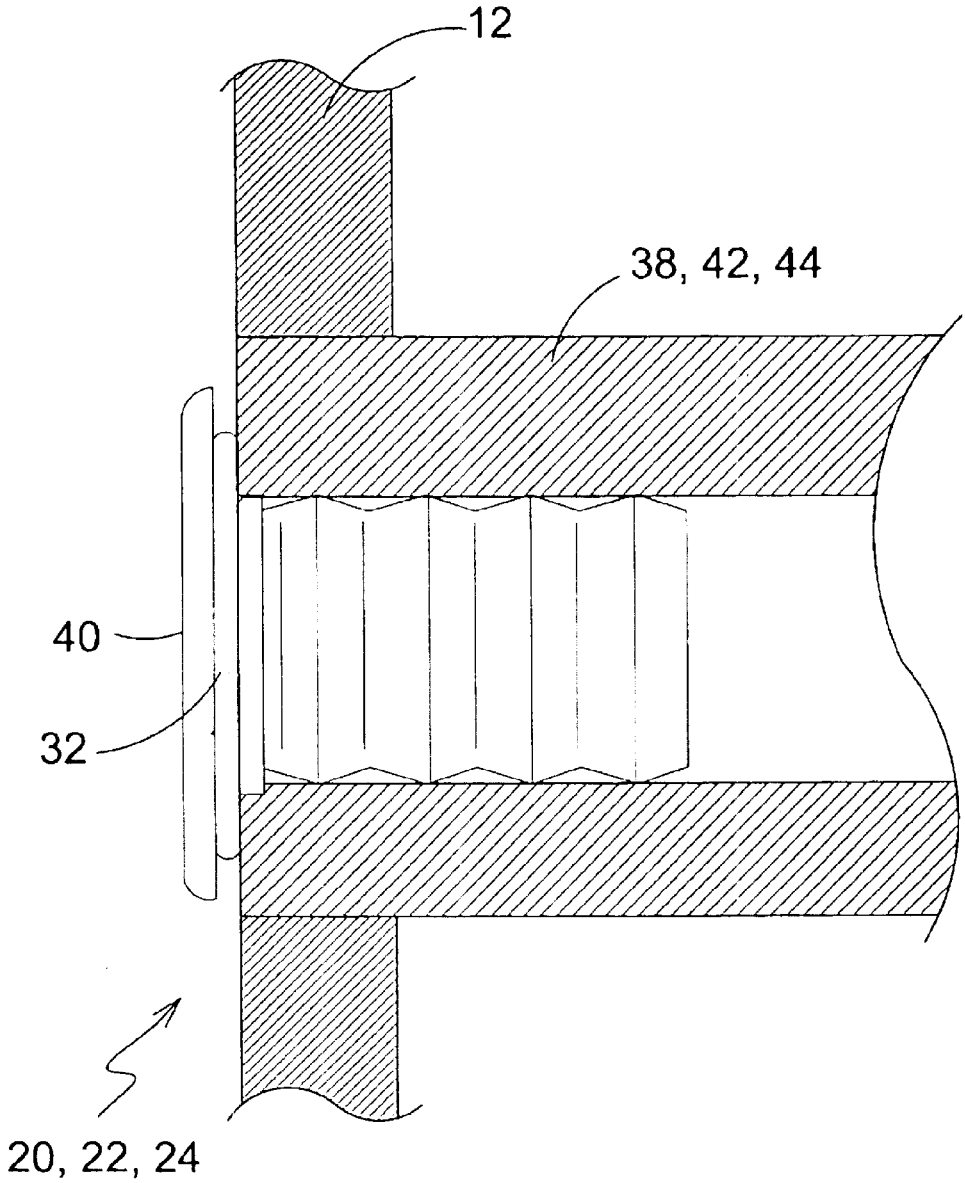
FIG. 10 is a sectional view of the present invention.

Turning to FIG. 10, shown therein is a sectional view of the present invention. Shown are the whirlpool bath 12 and replacement components for the jets 20 and pipe 44, air inlet 22 and air vacuum switch 24 having an O-ring 32 and solid cover 40.

We claim:

1. A kit for converting a whirlpool bathtub to a conventional bathtub, the whirlpool bathtub having a pump inlet, an air switch port, an air inlet port, and at least one jet outlet port disposed in the bathtub, further, the whirlpool bathtub having a pump and a pump motor and a vacuum line connected to the pump, the improvement comprising:

a) a first plug for insertion into the pump inlet, a solid cover and mating O-ring for attachment over the pump inlet to permit the pump inlet to be sealed;

b) a second plug having first and second ends, said plug being elongated on said first end for insertion into the air switch port, said plug having an enlarged cover on said second end and a mating O-ring for being disposed on said cover to permit the air switch port to be sealed;

c) a third plug having first and second ends, said plug being elongated on said first end for insertion into the air inlet port, said plug having an enlarged cover on said second end and a mating O-ring for being disposed on said cover to permit the air inlet port to be sealed; and, d) a fourth plug having first and second ends, said plug being elongated on said first end for insertion into the jet outlet port, said plug having an enlarged cover on said second end and a mating O-ring for being disposed on said cover to permit the jet outlet port to be sealed.

2. The kit of claim 1, wherein the pump motor is disconnected so that the pump motor is inoperative.

3. The kit of claim 2, wherein the vacuum line is disconnected from the pump so that the vacuum line is operative.

4. The kit of claim 3, wherein said first plug is complementarily sized to fit in the pump inlet.

5. The kit of claim 4, further comprising a plurality of fasteners for attaching said cover and said O-ring over the pump inlet.

6. The kit of claim 5, wherein said first end of said second plug is complimentarily sized to fit the air switch port.

7. The kit of claim 6, wherein said first end of said third plug is complimentarily sized to fit the air inlet port.

8. The kit of claim 7, wherein said first end of said fourth plug is complimentarily sized to fit the jet outlet port.

* * * * *